US005421430A

United States Patent [19]

Cox

[11] Patent Number: 5,421,430

[45] Date of Patent: Jun. 6, 1995

[54] COLLAPSIBLE SAWHORSE

[76] Inventor: George Cox, 3936 S. Jersey St., Denver, Colo. 80237

[21] Appl. No.: 152,733

[22] Filed: Nov. 15, 1993

[51] Int. Cl.[6] ..... E04G 1/00

[52] U.S. Cl. ..... 182/181; 182/153

[58] Field of Search ..... 182/153, 155, 181, 225, 182/151; 108/33, 150, 157

[56] References Cited

U.S. PATENT DOCUMENTS

| | | | |
|---|---|---|---|
| 965,173 | 7/1910 | Fassler . | |
| 1,114,336 | 10/1914 | Blomqvist . | |
| 1,435,738 | 11/1922 | Reiman . | |
| 2,396,737 | 3/1946 | Maclaskey | 182/155 |
| 2,473,342 | 6/1949 | Larson | 182/155 |
| 2,639,197 | 5/1953 | Chelsea | 182/155 |
| 2,664,319 | 12/1953 | Doucette | 182/151 X |
| 2,698,771 | 1/1955 | O'Rourk . | |
| 2,772,130 | 11/1956 | Pritchard | 108/33 X |
| 3,414,080 | 12/1968 | Doucette . | |
| 4,014,405 | 3/1977 | Breisch . | |
| 4,071,113 | 1/1978 | Pelser . | |
| 4,308,934 | 1/1982 | Jackson et al. . | |
| 4,711,319 | 12/1987 | Sansotta et al. . | |

FOREIGN PATENT DOCUMENTS

| | | | |
|---|---|---|---|
| 965173 | 7/1910 | Germany . | |
| 353228 | 10/1919 | Germany | 108/33 |
| 345498 | 8/1920 | Germany | 108/33 |
| 12335 | of 1911 | United Kingdom | 108/33 |

OTHER PUBLICATIONS

WOODWORK, Nov./Dec. 1992 brochure, p. 17.

*Primary Examiner*—Alvin C. Chin-Shue
*Attorney, Agent, or Firm*—John E. Reilly

[57] ABSTRACT

A collapsible sawhorse includes an upper body portion having an open-bottom, double-wall box configuration provided with four legs detachably securable in rectangular corner sockets by respective retaining pins secured against loss by flexible straps. A pair of spaced top panels on the upper body portion form a work surface of the sawhorse provided with a longitudinally extending gap dimensioned to receive a conventional screw operated wood working clamp. A pair of transversely spaced longitudinally extending storage compartments formed between inner and outer sidewall members of the upper body portion, on opposite sides of the longitudinal gap, each store a pair of the detached legs in stacked relation in a collapsed orientation of the sawhorse. Each storage compartment includes a pair of hinged doors having adjacent free ends meeting at an intermediate portion along the length of the storage compartment in a closed condition. A pivotal latch member spans the adjacent free ends of each pair of doors to maintain the doors in a closed condition. A plurality of the sawhorses may be stacked in the collapsed orientation in a small amount of space.

7 Claims, 2 Drawing Sheets

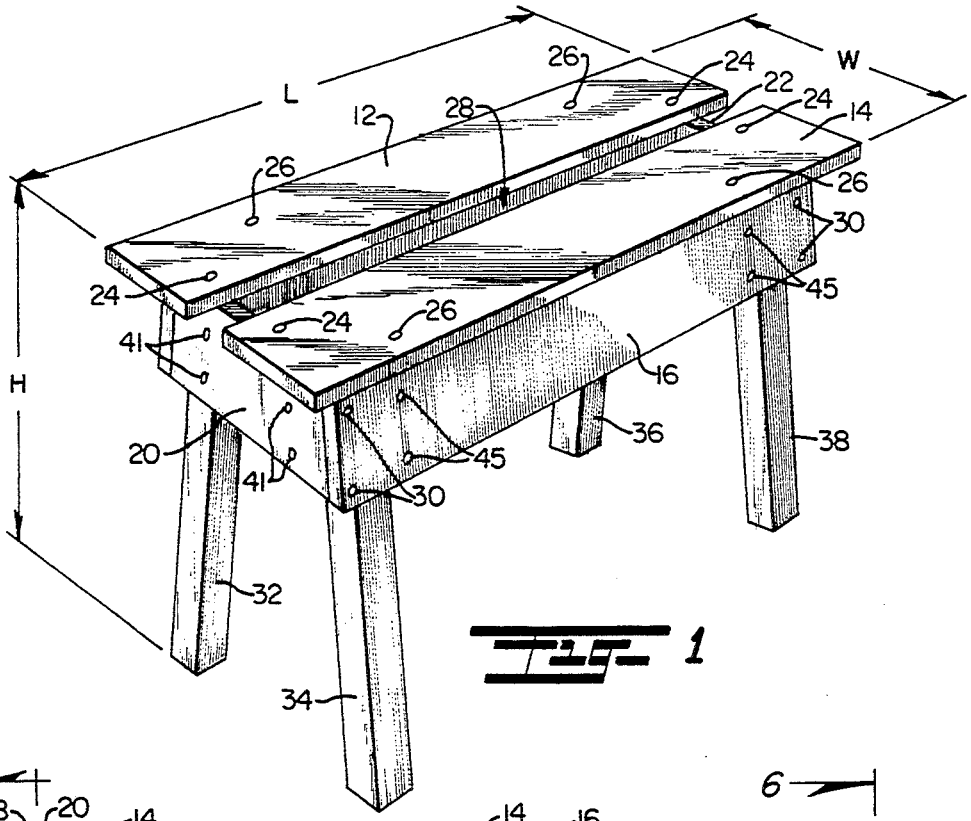
FIG. 1
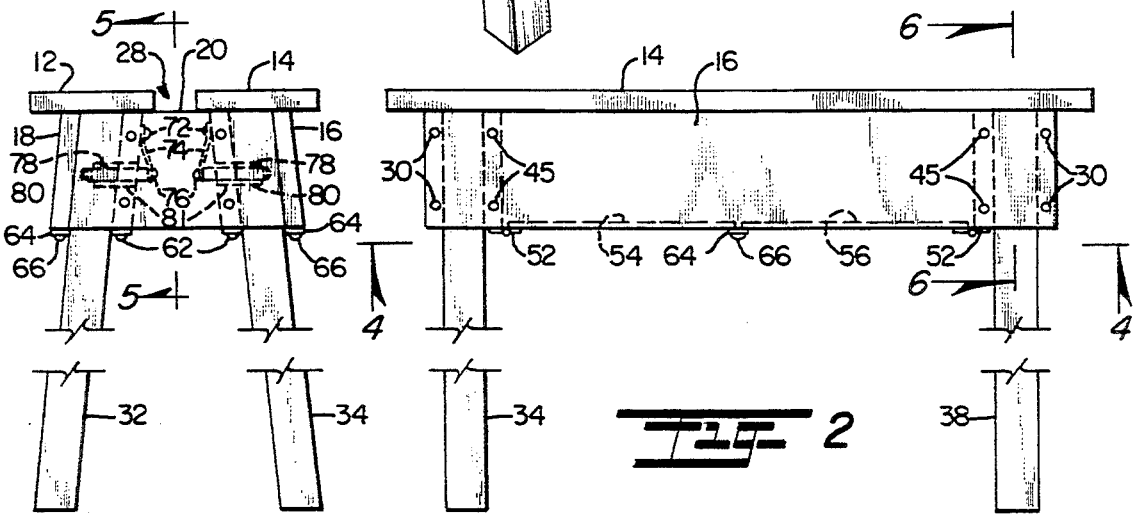
FIG. 2
FIG. 3
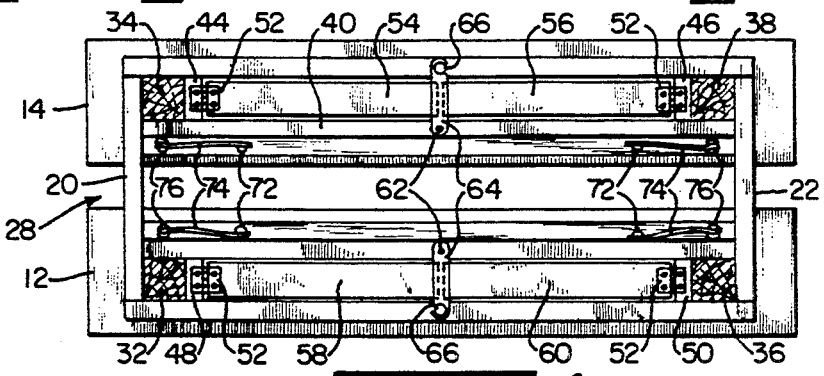
FIG. 4

COLLAPSIBLE SAWHORSE

BACKGROUND OF THE INVENTION

1. Field Of The Invention

The present invention relates to sawhorses and work supports, and more particularly pertains to a novel and improved collapsible sawhorse having detachable legs to facilitate transportation and storage. Carpenters and other construction workers typically employ portable work supports and sawhorses at construction sites to assist in the performance of various operations such as the layout and cutting of construction materials to required dimensions. Because a typical construction worker travels to several different job sites, with each job typically lasting from one day to several weeks, convenient portability of saw horses and work supports is a major concern.

2. Description Of The Prior Art

The field of portable work supports is crowded and includes a relatively great number of different collapsible and portable work supports and sawhorses. For example, U.S. Pat. No. 965,173, which issued on Jul. 24, 1909 to Fassler, discloses a collapsible trestle including pivotal legs secured by rivets to a central beam. U.S. Pat. No. 1,114,336, which issued on Oct. 20, 1914 to Blomqvist, discloses connecting blocks for use in knockdown sawhorses which each include three sockets provided with screw fasteners for securing legs and one end of a central beam portion of the sawhorse. U.S. Pat. No. 1,435,738, which issued on Nov. 14, 1922 to Reiman, discloses a collapsible sawhorse having pivotal legs securable in an erect position by a plurality of retaining pins, each secured against loss by a chain. U.S. Pat. No. 2,698,771, which issued on Jan. 4, 1955 to O'Rourk, discloses a sawhorse having four detachable legs secured in respective sockets by leaf spring mounted retaining pins. A hinged door in one end of the central beam communicates with an elongated storage compartment which receives the detached legs in side-by-side relation for storage. The device disclosed in the patent to O'Rourk requires precise alignment and endwise insertion of the detached legs through a common opening in the end of the sawhorse central beam. U.S. Pat. No. 3,414,080, which issued on Dec. 3, 1968 to Doucette, discloses a collapsible sawhorse including pivotal spring biased legs which store in a collapsed orientation in overlying relation within a central body portion of the sawhorse. U.S. Pat. No. 4,014,405, which issued on Mar. 29, 1977 to Breisch, discloses a knockdown sawhorse having detachable legs including wedge-shaped upper end portions dimensioned for insertion into recesses disposed on opposite ends of the central beam. U.S. Pat. No. 4,071,113, which issued on Jan. 31, 1978 to Pelser, discloses a sawhorse including integrally formed X-shaped leg pairs selectively securable to opposite ends of a central beam by U-shaped retaining pins. U.S. Pat. No. 4,308,938, which issued on Jan. 5, 1982 to Jackson et al., discloses a collapsible sawhorse which employs frame members possessing clamps for the detachable securement of legs. U.S. Pat. No. 4,711,319, which issued on Dec. 8, 1987 to Sansotta et al., discloses a collapsible sawhorse including pivotal legs which fold into an open-bottomed storage compartment in a central beam portion of the sawhorse.

Among other features of the present invention, it is desirable to provide for convenient storage of the legs of the sawhorse in one or more compartments beneath the work surface, particularly a sawhorse of the type having an upper work surface which will accommodate a conventional type of clamp in a gap in the work surface.

SUMMARY OF THE INVENTION

It is an object of the present invention to provide for a novel and improved sawhorse which is easily collapsible, without the use of tools, for purposes of transportation and storage.

It is another object of the present invention to provide for a novel and improved collapsible sawhorse wherein novel retaining mechanisms allow detachment of the sawhorse legs for purposes of transportation and storage.

It is a further object of the present invention to provide for a novel and improved collapsible sawhorse including storage compartments for storing the detached legs in stacked relation in the collapsed orientation.

It is yet another object of the present invention to provide for an improved collapsible sawhorse having a novel and improved door and latch mechanism for the leg storage compartments.

It is a still further object of the present invention to provide for a collapsible sawhorse having novel and improved mechanisms for detachably securing the sawhorse legs in an erect orientation and for storing the legs in a collapsed orientation.

A still further object of the present invention is the provision of a sawhorse having a work surface including a longitudinally extending gap dimensioned to receive a conventional wood working clamp.

Yet another object of the present invention is the provision of an extremely durable and easily transportable sawhorse susceptible of low cost manufacture and thus economically available to the consuming public.

In order to achieve these and other objects of the invention, the present invention provides an improved sawhorse, selectively configurable in erect and collapsed orientations, which includes an upper body portion and a plurality of selectively detachable legs. The upper body portion has at least one storage compartment, dimensioned for storing the legs when detached, and also includes a pair of doors for selectively closing an open bottom end of the storage compartment.

Advantageously, the sawhorse of the present invention includes an upper body portion having a work surface provided with an elongated gap for receiving a conventional wood working clamp, and also having two elongated leg storage compartments disposed on opposite sides of the gap. Each storage compartment preferably includes an entrance sized for insertion of the detached legs.

In an illustrated preferred embodiment, the upper body portion of the sawhorse has an open-bottom, double-wall box configuration with two transversely spaced storage compartments extending between opposite inner and outer sidewall members, with each storage compartment being selectively closable by a pair of hinged doors. The storage compartments are preferably sized such that two detached legs may be stored in stacked relation within each compartment. Pivotal latch members span adjacent free ends of the hinged doors to maintain the doors in a closed condition. A pair of top panels disposed in spaced relation to one another form a work surface of the sawhorse which is provided with a full length longitudinal gap dimensioned to receive a conventional screw-operated, wood working clamp.

Respective retaining pins, each secured against loss by a flexible strap, secure the detachable legs in four rectangular leg sockets disposed adjacent to corner portions of the upper body portion. The retaining pins extend through reinforcing sleeves disposed in aligned apertures in the legs and one wall of the associated socket.

The above and other objects, advantages and features of the present invention will become more readily appreciated and understood when taken together with the following detailed description in conjunction with the accompanying drawings, in which:

BRIEF DESCRIPTION OF THE DRAWINGS

FIG. 1 is a perspective view of the collapsible sawhorse according to the present invention in an erect orientation.

FIG. 2 is a side elevational view, partially cutaway, illustrating the collapsible sawhorse of the present invention in an erect orientation.

FIG. 3 is an end elevational view, partially cutaway, illustrating the collapsible sawhorse of the present invention in an erect orientation.

FIG. 4 is a cross-sectional view, taken along line 4—4 of FIG. 2, illustrating leg storage compartments of the collapsible sawhorse of the present invention.

DETAILED DESCRIPTION OF THE PREFERRED EMBODIMENT

Figure 5:
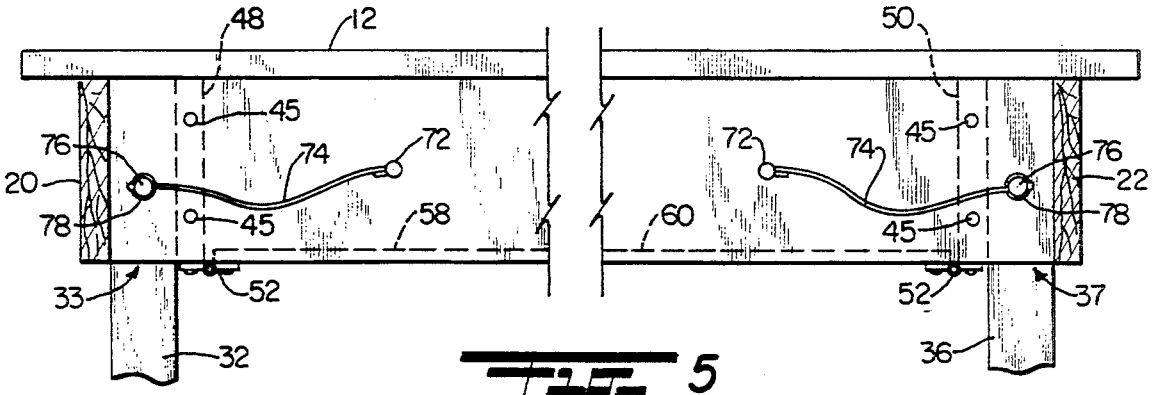
FIG. 5 is a cross-sectional detail view, taken along line 5—5 of FIG. 3, illustrating detachable leg mounting structure of the collapsible sawhorse of the present invention.

Referring now to the drawing FIGS. 1–8, wherein like reference numerals designate corresponding structure throughout the views, an improved sawhorse 10 according to a preferred embodiment of the invention generally comprises a plurality of planar wood panel members 12, 14, 16, 18, 20, and 22 permanently secured together to form an upper body portion having a generally open-bottom box configuration. Conventional fasteners such as dowels, screws, nails, staples, glue, etc., effect securement of the panel members. Four detachable legs 32, 34, 36, and 38 extend downwardly from the upper body portion of the sawhorse 10 in the erect condition best shown in FIG. 1.

More specifically, the upper body portion of the sawhorse 10 includes a pair of elongated rectangular work surface panels 12 and 14 extending in spaced parallel relation to one another and having coplanar upper surfaces adapted to support work pieces thereon. In an important feature of the invention, the panels 12 and 14 are spaced transversely apart about 2.0 inches to form a longitudinal gap 28 dimensioned to receive a conventional screw-operated wood working clamp therein. This conventional type of clamp includes two clamping jaws mounted for relative movement to a wide variety of selected adjusted positions along an elongated threaded rod for clamping engagement with a work piece. In use in conjunction with the sawhorse of the present invention, the threaded rod of the clamp is received in the gap 28 such that work pieces may be conveniently supported in a desired orientation on or adjacent to the work surface formed by the panels 12 and 14. A pair of elongated rectangular outer sidewall members 16 and 18 depend downwardly from bottom surfaces of the panels 12 and 14, and diverge outwardly and downwardly, such that upper ends of the outer sidewall members 16 and 18 are closer together than their bottom ends. A pair of trapezoidal end wall members 20 and 22 extend in spaced parallel relation to one another transversely between opposite end portions of the outer sidewall members 16 and 18. A plurality of conventional fasteners, such as screws, dowels, or nails, preferably in conjunction with ornamental cap plugs and optionally also in combination with glue, effect permanent securement of the members 12, 14, 16, 18, 20, and 22 in a generally open-bottom box configuration. In the illustrated embodiment, a plurality of fasteners 24 secure opposite ends of the panels 12 and 14 to top edges of the end wall members 20 and 22; a plurality of fasteners 26 secure outer side portions of the panels 12 and 14 to top edges of the outer sidewall members 16 and 18; and a plurality of fasteners 30 secure opposite end portions of the outer sidewall members 16 and 18 to end edge portions of the end wall members 20 and 22.

Figure 6:
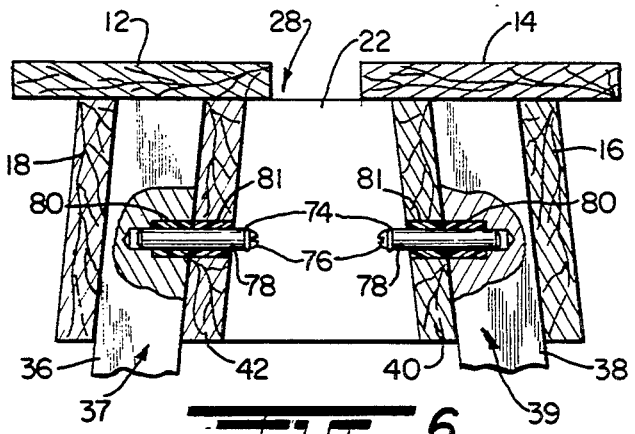
FIG. 6 is a cross-sectional view, taken along line 6—6 of FIG. 2, partially cut-away, illustrating releasable leg retaining pins securing detachable legs of the collapsible sawhorse of the present invention in an erect condition.
Figure 7:
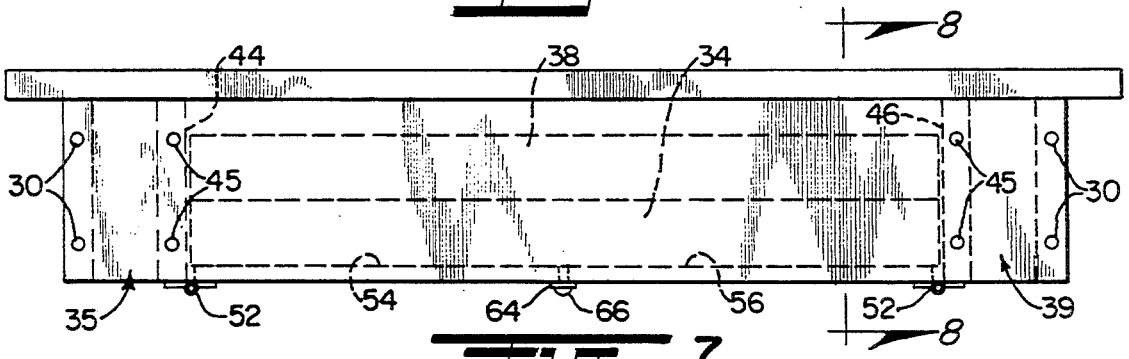
FIG. 7 is a side elevational view illustrating the collapsible sawhorse of the present invention in a collapsed condition.
Figure 8:
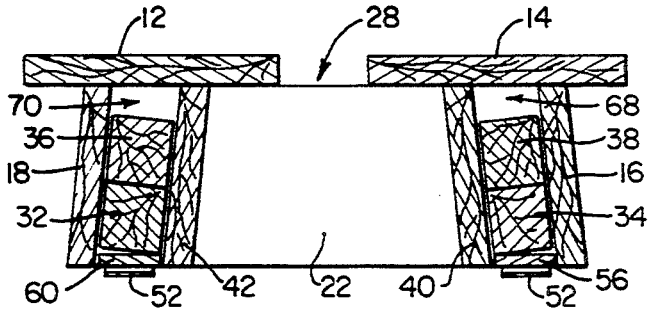
FIG. 8 is a cross-sectional view, taken along line 8—8 of FIG. 7, illustrating the detached legs of the collapsible sawhorse of the present invention disposed within leg storage compartments.

The four legs 32, 34, 36, and 38 extend downwardly and outwardly in a diverging manner, as shown in FIGS. 1 and 3, from corner portions of the upper body portion of the sawhorse 10. For the purpose of providing for the selective detachable mounting of the legs, the sawhorse 10 includes four square or rectangular corner sockets 33, 35, 37, and 39 dimensioned for insertion of the respective legs 32, 34, 36, and 38. When detached, the legs may be conveniently stored in longitudinally extending compartments 68 and 70 formed in the upper body portion of the sawhorse 10, as shown in FIG. 8. Toward this end, the sawhorse 10 has a double-wall construction including inner sidewall members 40 and 42 extending in spaced parallel relation adjacent respective outer sidewall members 16 and 18, as depicted in FIGS. 4, 6, and 8. With reference to FIG. 1, a plurality of fasteners 41 secure opposite ends of each of the inner sidewall members 40 and 42 to the end wall members 20 and 22. As best shown in FIG. 4, a plurality of blocks 44, 46, 48, and 50 define inner boundaries of the corner leg sockets 33, 35, 37, 39 and also define opposite ends of the leg storage compartments 68 and 70. A plurality of fasteners 45 secure the blocks 44, 46, 48, and 50 transversely between the outer and inner sidewall members 16 and 40 or 18 and 42.

Each of the leg storage compartments 68 and 70 includes an open bottom selectively covered by a pair of hinged doors 54, 56 and 58, 60, respectively, with each of the doors including an outer end secured by a hinge 52 to one of the blocks 44, 46, 48, or 50, and a free inner end disposed closely adjacent a free inner end of the other compartment door of the pair at an intermediate location along the length of the storage compartment. A pair of pivot pins 62 rotatably mount inner ends of pivotal latch members 64 for the purpose of selectively securing the storage compartment doors in a closed position. In a latched condition, outer hooked ends of each of the latch members 64 engage fixed projecting members such as projecting nail or screw heads 66, so that the latch members 64 laterally span the inner free ends of the compartment door pairs 54, 56 and 58, 60, blocking them against downward movement.

With reference to FIGS. 3–6, the mechanism for detachable securement of each of the legs includes a screw or other fastener securing one end of a flexible strap 74 to an inner face of one of the inner sidewall members 40 or 42. Another screw 76 secures an opposite end of each strap 74 to a retaining pin 78, preferably taking the form of a wooden dowel, thus securing the retaining pins 78 against loss. As best shown in FIG. 6, the retaining pins 78, in an erect condition of the legs, extend laterally through nylon, metal, or plastic sleeves 80 and 81 disposed in aligned blind bores in each of the legs and in apertures extending through the associated inner sidewall member 40 or 42. The retaining pins 78, in conjunction with the closely conforming leg receiving sockets 33, 35, 37, and 39, and the weight of the sawhorse upper body portion, serve to retain the legs securely in position during use of the sawhorse 10.

In order to collapse the sawhorse 10 from the erect condition shown in FIG. 1, a user first inverts the sawhorse 10 such that the panels 12 and 14 rest upon a ground or floor surface, with the legs 32, 34, 36, and 38 extending generally upwardly. The user then withdraws each of the retaining pins 78 from engagement within the sleeves 80 and 81 (FIG. 6), and then pulls each leg upwardly out of its respective corner socket 33, 35, 37, or 39. The open unobstructed region in the sawhorse upper body portion between the inner sidewall members 40 and 42 provides convenient access for manipulation of the retaining pins 80, which are hidden from view in the upright erect orientation of the sawhorse 10. The user then pivots the latch members 64 (FIG. 4) to an unlatched position, opens door pairs 54, 56 and 58, 60, inserts one pair of the legs into each of the compartment 68, 70, and then closes and latches the doors. The user may then conveniently store and transport the sawhorse 10. In particular, the present inventions allows storage of a plurality of sawhorses 10 in stacked relation in the collapsed orientation. Although the compartments 68 and 70 are intended primarily for leg storage, other miscellaneous items may also be stored therein, particularly in the erect condition of the sawhorse 10.

From the foregoing, it will be evident that laterally opening slots communicating with the storage compartments may be provided in addition to, or in place of the open bottoms. For example, each of the compartments 68 and 70 may have a solid bottom, with elongated laterally opening access slots formed in the inner sidewall members 40 and 42. Alternatively, the access slots may open outwardly through the outer sidewall members 16 and 18. It should be noted that in each of the illustrated and above-described alternative embodiments, the leg storage compartments extend parallel to each other and to the elongated gap 28 with an entrance which will enable lateral insertion of the legs in a direction transversely of their lengths. Further, the compartments are disposed on opposite sides of the centrally disposed gap 28 and are spaced equidistant therefrom, providing for a uniform and symmetric weight distribution which facilitates transportation and storage.

While hardwoods, such as baltic birch, are the preferred material for the various components of the collapsible sawhorse 10, a wide variety of other materials such as plastic, sheet metal, fiberglass, laminated wood fibre materials, etc., may also be employed without departing from the scope of the present invention.

Although the sawhorse 10 may be formed in a wide variety of different sizes, the work surface formed by the panels 12 and 14 preferably has a length L of about 29.0 inches and a width W of about 12.0 inches and a height H of about 20.0 inches. These selected dimensions provide a highly functional work support, while still allowing the sawhorse 10 to collapse to a conveniently small size for transportation and storage.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed, and reasonable equivalents thereof.

I claim:

1. A sawhorse selectively configurable in erect and collapsed orientations, comprising:

an upper body portion having a double wall construction and including a work surface provided with a longitudinally extending gap;

a plurality of legs, each of said legs being of one-piece construction;

securing means for selectively detachably securing said legs to corners of said upper body portion including leg socket means at each said corner for supporting said legs in said erect orientation; and a pair of longitudinally extending storage compartments spaced equidistantly on opposite sides of said gap between said sidewall members, each of said storage compartments dimensioned to be of a length greater than that of each of said legs for storing pairs of said legs, said legs being stored in vertically stacked relation to one another in each of said compartments when detached from said upper body portion, said storage compartments each including an entrance sized for lateral insertion of said pair of said legs into each said storage compartment, and a pair of doors extending from respective hinges secured adjacent to opposite ends of said storage compartments and having free end portions disposed in closely adjacent relation to one another at an intermediate portion along the length of said storage compartments in a closed condition.

2. The sawhorse of claim 1, further comprising a latch for maintaining said pair of doors in said closed condition.

3. The sawhorse of claim 2, wherein said latch comprises a pivotal member dimensioned to span said free end portions of said doors in said closed condition.

4. The sawhorse of claim 1, wherein said means for detachably securing said legs comprises a plurality of retaining pins dimensioned for insertion at least partially through aligned apertures in said upper body portion and said legs.

5. The sawhorse of claim 1, further comprising a latch for maintaining said door in a closed condition.

6. The sawhorse of claim 1, wherein said leg socket means are disposed at opposite ends of said storage compartments, each of said leg socket means dimensioned for insertion of one of said plurality of legs.

7. A sawhorse selectively configurable in erect and collapsed orientations, comprising:

an upper body portion having an open-bottom, double-wall box configuration including a pair of spaced parallel transversely extending trapezoidal end wall members connected by a pair of longitudinally extending elongated rectangular outer sidewall members, said outer sidewall members diverging downwardly and outwardly;

a pair of elongated rectangular inner sidewall members secured in spaced parallel relation to said outer sidewall members;

a pair of elongated rectangular coplanar work surface panels secured atop said end wall members and said inner and outer sidewall members, said work surface panels separated by a longitudinally extending gap;

a block disposed adjacent to each corner portion of said upper body portion, each of said blocks secured transversely between said inner and outer sidewall members;

a rectangular leg socket disposed adjacent to each said corner portion of said upper body portion, each of said leg sockets enclosed by portions of said inner and outer sidewall members, one of said end wall members, and one of said blocks;

elongated legs each dimensioned for insertion into one of said sockets with an aperture disposed through each one of said inner sidewall members and communicating with one of said leg sockets and a blind bore disposed in each one of said legs and in coaxial alignment with one of said apertures when said legs are inserted within said leg sockets;

retaining pins each secured against loss by a strap to one of said inner sidewall members adjacent to one of said leg sockets and dimensioned for insertion through one of said apertures and into one of said bores for retaining one of said legs in one of said leg sockets;

a pair of longitudinally extending transversely spaced leg storage compartments, each of said leg storage compartments extending between one of said inner sidewall members and one of said outer sidewall members and having an open bottom end, extending along its substantial length each of said leg storage compartments dimensioned for lateral insertion of two of said legs in stacked relation when detached from said sockets, said leg storage compartments spaced equidistantly on opposite sides of said longitudinally extending gap;

a pair of doors for selectively closing each said open bottom end of said leg storage compartments, outer ends of each one of each of said pairs of doors secured by a hinge to one of said blocks and inner ends of each one of each of said pairs of doors disposed in closely adjacent relation to one another at an intermediate location along said leg storage compartments; and a latch member, mounted on each of said inner sidewall members for selective pivotal movement to a latched position spanning said inner ends of one of said pairs of doors for maintaining said doors in a closed position across said open bottom ends of said storage compartments, each of said latch members including a hooked end portion selectively engageable with a projecting member on one of said outer sidewall members to maintain said latch member in said latched position.

* * * * *